United States Patent [19]

Finke et al.

[11] 4,453,915

[45] Jun. 12, 1984

[54] METHOD AND APPARATUS FOR UNDERFIRING OIL COUNTRY TUBE REHEAT FURNACES

[75] Inventors: Harry P. Finke, Pittsburgh, Pa.; Robert A. Shannon, Avon Lake, Ohio

[73] Assignees: Bloom Engineering Company, Inc.; United States Steel Corporation, both of Pittsburgh, Pa.

[21] Appl. No.: 411,497

[22] Filed: Aug. 25, 1982

[51] Int. Cl.[3] ..... F27D 3/00; F27B 9/14

[52] U.S. Cl. ..... 432/11; 432/122; 432/130; 432/146

[58] Field of Search ..... 432/11, 122, 124, 130, 432/146

[56] References Cited

U.S. PATENT DOCUMENTS

| | | | |
|---|---|---|---|
| 2,045,920 | 6/1936 | Parmelee | 432/11 |
| 2,235,771 | 3/1941 | McDermott | 432/146 |
| 3,212,763 | 10/1965 | Foldessy | 432/146 |
| 3,540,706 | 11/1970 | Wilt, Jr. | 432/124 |
| 3,623,715 | 11/1971 | Costick et al. | 432/11 |
| 3,716,222 | 2/1973 | Anderson | 432/234 |
| 4,025,298 | 5/1977 | Tokitsu | 432/122 |
| 4,102,449 | 7/1978 | Shufran | 432/122 |
| 4,214,866 | 7/1980 | Thekdi et al. | 432/222 |

*Primary Examiner*—John J. Camby

*Attorney, Agent, or Firm*—Webb, Burden, Robinson & Webb

[57] ABSTRACT

The improvement in a walking beam oil country tube reheat furnace comprises a first row of burners positioned in spaced relationship and transverse the furnace hearth with each of the burners containing a refractory housing positioned in the limited space between the walking beam pass line and the hearth of the furnace. The burner includes a burner body and a centrally disposed fuel tube so as to define an annular air chamber thereabout. The burner includes a 90° bend so as to fire in parallel relationship to the pass line. The method of retrofitting a top fired walking beam furnace includes inserting at least one unitized bung of said spaced burners through the furnace floor and into the space between the pass line and floor and firing the burners in parallel relationship with the pass line.

9 Claims, 6 Drawing Figures

METHOD AND APPARATUS FOR UNDERFIRING OIL COUNTRY TUBE REHEAT FURNACES

FIELD OF THE INVENTION

Our invention relates generally to walking beam furnaces and more particularly to method and apparatus for underfiring oil country tube walking beam reheat furnaces.

DESCRIPTION OF THE PRIOR ART

The early developed reheat furnaces for the heavy metal industry and particularly the steel industry, were generally of the pusher type with the furnace being fully charged with product in abutting side-by-side relationship and the product being pushed through the furnace on skids by the introduction of additional product through an appropriate charging door. These furnaces, some of which are still in operation, are generally heated by a plurality of gaseous or liquid fuel burners, which burners are positioned to provide both over and underfiring of the product. The furnace is often segmented into a heating zone and a soak zone by means of appropriate baffles.

Many of the pusher type reheat furnaces were replaced for various applications by walking beam furnaces which have the capability of moving discrete shapes through a furnace at the desired speed and temperature and in spaced relationship to one another. Utilization of the walking beam reduced skid marks on the product and eliminated the problem of processing diverse product mix, e.g. pushing heavy product with light product or long product with short product. In addition, the problems of product sticking together and surface defects caused by dropout chutes and furnace bumpers were eliminated through the walking beam furnace. Also, the heat treating was improved in certain respects because of the space between adjacent product which allows for more uniform heating. Walking beam furnaces have particular application to bar, rod and tube stock where the product is retained on saddles mounted to the walking beams so as to be efficiently moved through the furnace.

One of the problems associated with walking beam furnaces is that a substantial amount of hardware is associated with the walking beam conveyor with that hardware being positioned from the pass line to the furnace hearth and well into the foundation and subfoundation. This hardware includes all of the hydraulics, beams, couplings, cranks and lifting trusses which are necessary to provide both a rectilinear lift stroke and a forward or reversed stroke to the conveyor means. Because of all of the hardware associated with the walking beams, and particularly the beam structure itself located between the pass line and the hearth, heating of walking beam furnaces is generally top fired only with burners positioned in the respective end walls and side walls above the walking beam pass line.

Attempts have been made to build underfired walking beam furnaces in general but such attempts have been extremely costly because of the need to provide adequate space between the walking beam pass line and the furnace hearth. In addition to the space, complex forms of support structures have been required to give the overall furnace the requisite structural integrity. Representative examples of underfired walking beam furnaces are those disclosed in U.S. Pat. Nos. 3,450,394; 3,716,222; and 3,820,946. Despite the recognition that walking beam furnaces can be underfired by providing additional space and support structure, several generations of top fired reheat furnaces and particularly oil country tube reheat furnaces are in existence which presently can only be top fired.

In the case of oil country tube reheat furnaces which employ a walking beam conveyor system attempts to increase productivity by running the furnace hotter have only resulted in a greater temperature differential between the top of the tube and the bottom of the tube, thereby causing warpage with the tubes actually lifting out of the saddles as this warping takes place. In addition, heat treating quality has not been good due to these temperature differentials because the temperature below the product can't be controlled. With underfiring, as in the subject invention, these temperatures can be accurately controlled. With the additional burner under the discharge opening controlled separately, hardness of the pipe ends will be the same as the balance of the pipe. With only top firing, the underneath temperature can't be controlled which results in hard ends or poor quality.

SUMMARY OF THE INVENTION

Our invention permits the existing several generations of walking beam furnaces and particularly the walking beam oil country tube reheat furnaces to be retrofit for underfiring. This underfiring is provided without the need to alter the walking beam mechanism or add additional structural support to the existing facilities. By providing underfiring to these existing furnaces, improved productivity is realized as the heating time is effectively reduced by a factor of approximately two to one. In addition, bowing or warpage of the product is eliminated because of the elimination of the temperature differential created in the product when top firing only is used.

Several options in respect of the direction of heating are available and countercurrent or cocurrent heat flow can normally be accomplished unless flue position or existing walls restrict the flow in a certain manner.

Our invention provides for retrofitting a top fired walking beam furnace having a limited space between the walking beam pass line and the floor of the furnace (the furnace hearth) to include underfiring. Retrofitting includes inserting at least one unitized bung of spaced burners each of which includes a right angle turn with the unitized bung extending transversely of and through the furnace floor and into the space between the pass line and the floor. The burners are fired in parallel with the pass line. The burners are contained within a refractory housing positioned in the limited space and include a centrally disposed fuel pipe having a right angle bend so as to exit into the space in parallel relationship to the product on the walking beam. A burner body surrounds the fuel pipe and forms an annular air chamber thereabout and an apertured baffle is located at one end of the air chamber so as to direct air in mixing relationship with the fuel. An air header extends beneath the furnace floor and is co-directional with the spaced burners. Connecting means join the header and each burner in fluid communication and a gaseous or liquid fuel line connects to each of the fuel pipe inlet ends.

DESCRIPTION OF THE PREFERRED EMBODIMENTS

Figure 1:
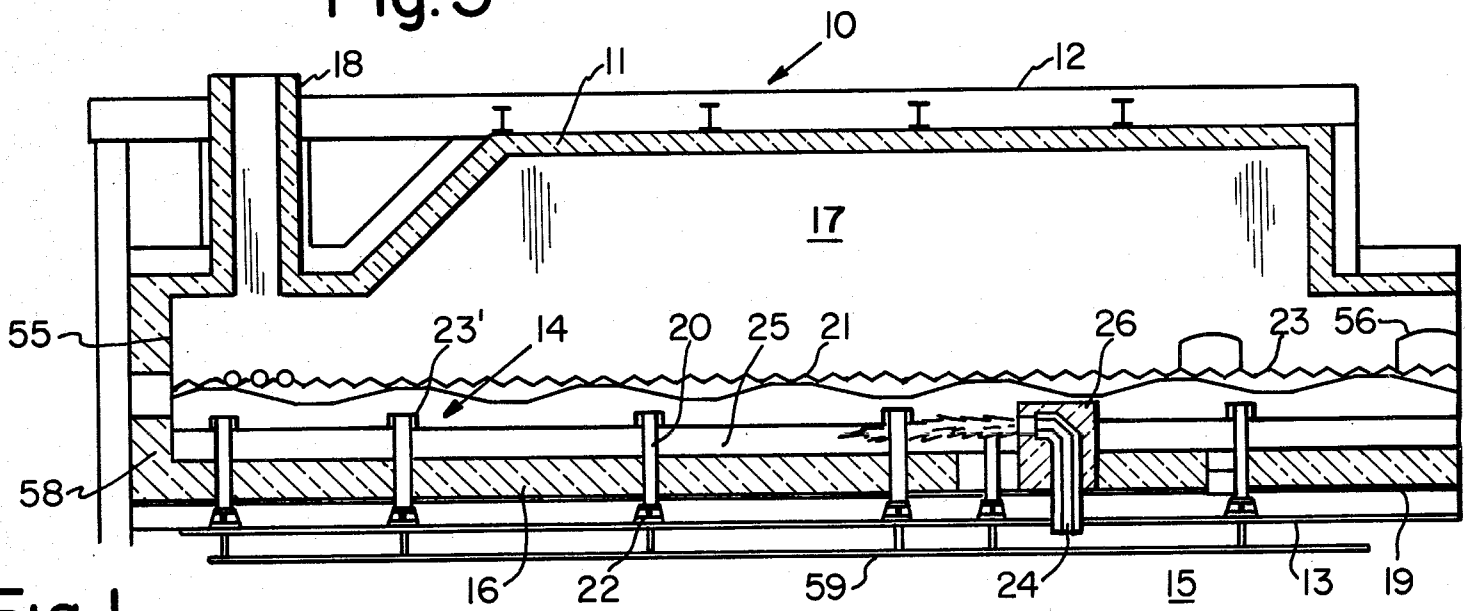
FIG. 1 is a schematic in longitudinal section of a top fired country tube walking beam reheat furnace retrofitted with our invention.
Figure 2:
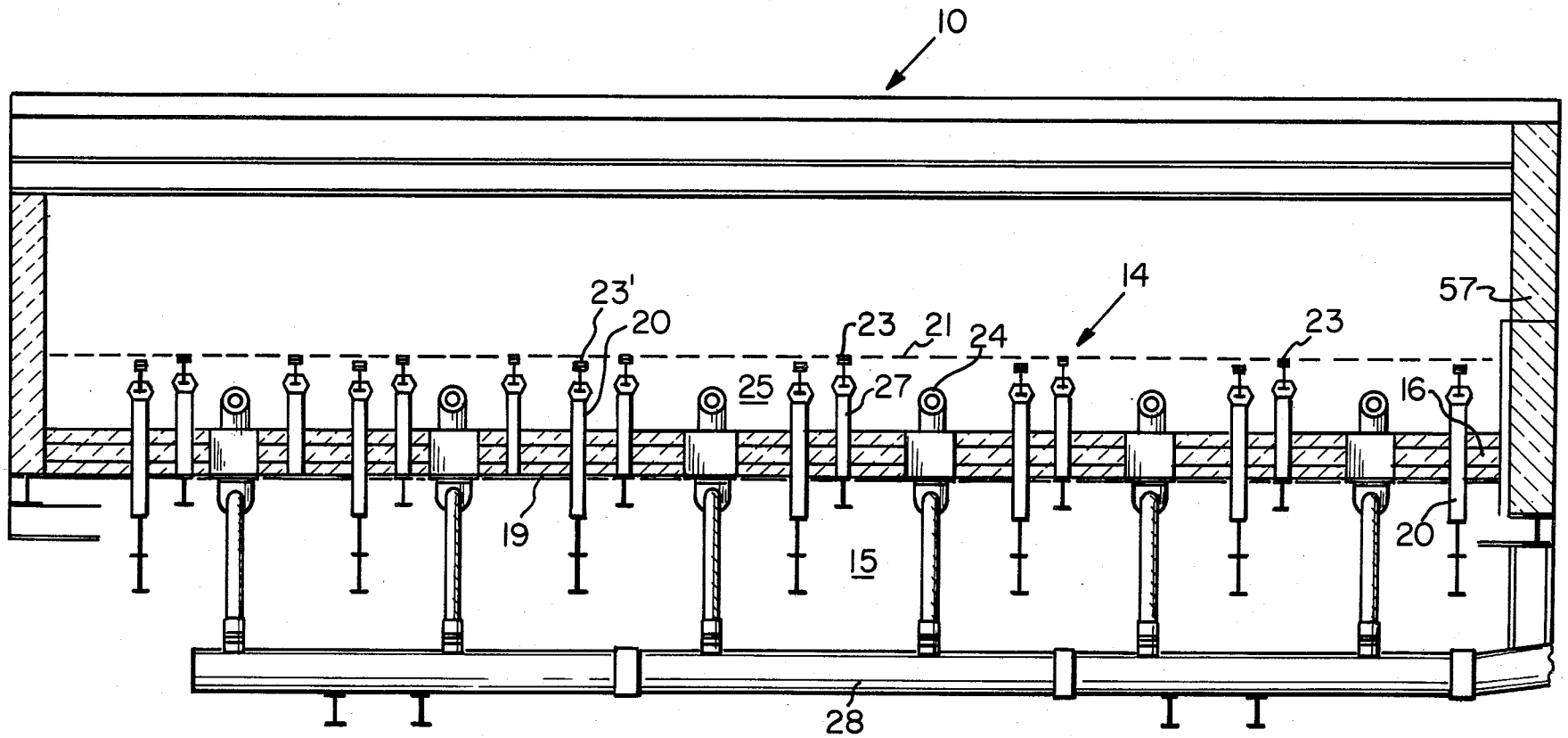
FIG. 2 is a transverse section of the furnace of FIG. 1 showing a unitized bung of underfired burners.

One form of oil country tube reheat furnace generally designated 10 embodying our invention is illustrated in FIGS. 1 and 2. The furnace 10 is generally elongated and includes a roof assembly 12, a floor assembly 13, side walls 57 and end walls 58. The roof assembly and walls include a refractory lining 11 and the floor assembly includes a refractory lined hearth 16, which protects the various superstructures (not shown) and permits heating to take place within the furnace chamber 17.

The oil country tubing is conveyed through the furnace 10 by means of the walking beam conveyor 14, FIGS. 1 and 2. The walking beam conveyor 14 includes spaced rows of walking beams 20 and fixed beams 27 with the respective beams also positioned in spaced relationship along each row. The walking beams 20 terminate at their upper end in saddles 23' which retain the tubing as it is conveyed through the furnace chamber 17. The fixed beams 27 terminate in the fixed saddle 23 which receive and retain the tubing from the walking beam saddles. The beams 20 extend downwardly through the refractory furnace hearth 16, the floor assembly 13, which includes a hearth floor 19 and into the subfoundation area 15. The walking beams 20 are connected together by lifting trusses 59 so as to effect the proper synchronization during movement. The various hydraulic systems, drives, cranks and controls which form part of the walking beam conveyor 14 are not shown and do not form part of the subject invention.

The height of the saddle 23 above the furnace hearth 16 defines the pass line 21 for tubing to be heat treated. The space 25 between the pass line 21 and the furnace hearth 16 is substantially limited by the plurality of walking beams, fixed beams and related equipment and may be on the order of only 12" in height. A unitized bung of burners 24 is inserted through the floor assembly 13, hearth floor 19 and furnace hearth 16 so as to fire into the limited space 25.

Figure 3:
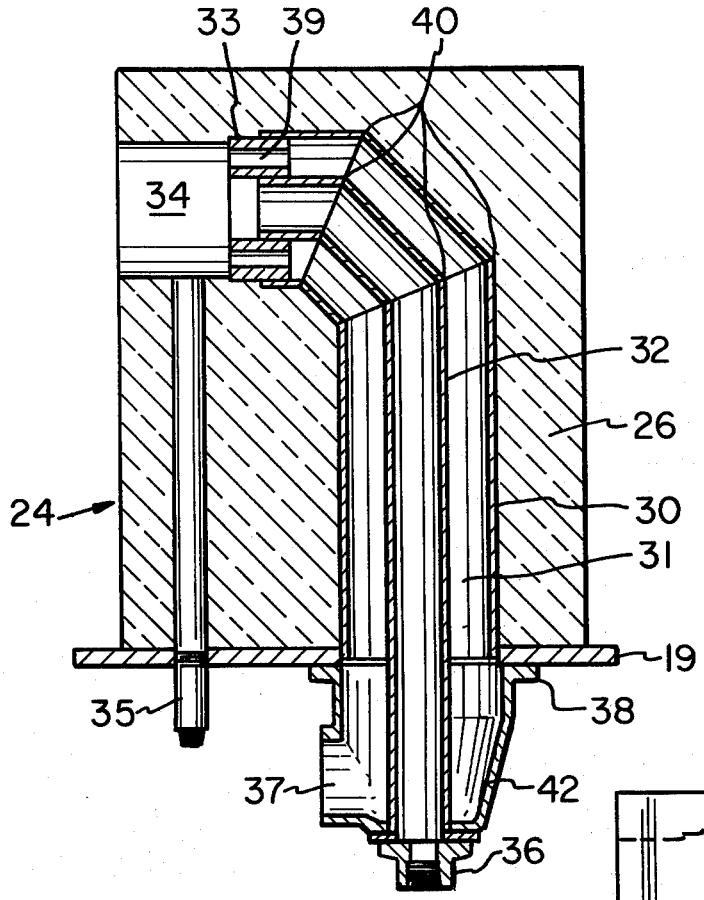
FIG. 3 is a vertical section through a refractory block housing our burner.
Figure 4:
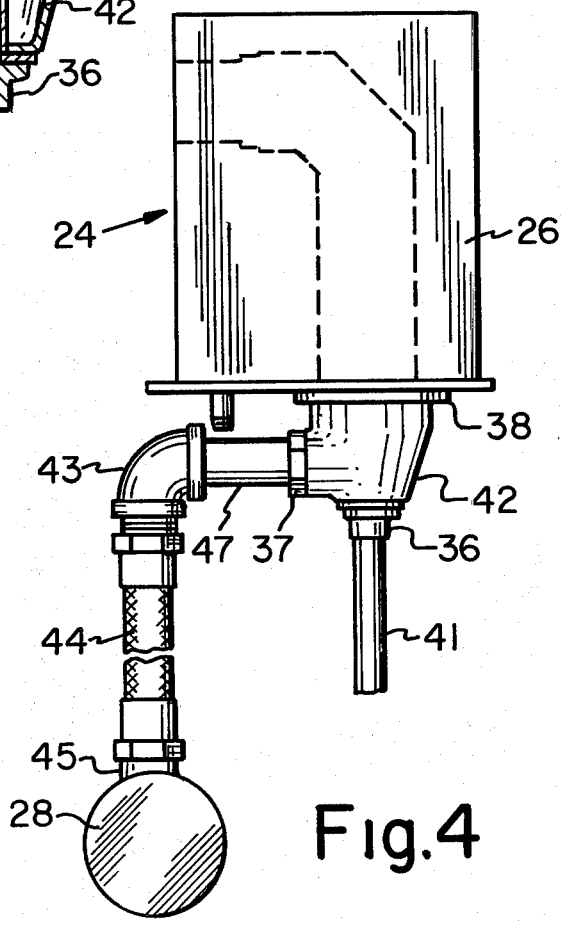
FIG. 4 is an end elevation of our burner.

Each burner 24 is housed in a refractory shell 26, FIGS. 3 and 4. The burner 24 includes a central fuel tube 32 coaxially positioned within a burner body 30 so as to define an annular air chamber 31 therebetween. The burner body 30 and fuel tube 32 include a series of bends 40 so as to form a right angle turn within the refractory 26. A baffle 33 having a series of apertures 39 closes off the discharge end of the air chamber 31. Baffle 33 extends about the discharge end of fuel tube 32. The discharge takes place in a port block 34 formed in the refractory 26 and a pilot tube 35 extends through the hearth floor 19 and into the port block 34 for ignition purposes. The end of the burner 24 opposite the discharge end extends through the hearth floor 19 and is mounted thereto by a burner housing 42 which includes an air inlet 37 into the air chamber 31 and an opening to accommodate the fuel tube 32 which terminates in fuel tube inlet coupling 36.

Each burner 24 connects to a common air header 28 which extends across the furnace hearth 16 and in the subfoundation 15 of the furnace 10, FIGS. 2 and 4. It will be recognized that a single manifold or air header is not always possible and that the existing furnace or process may require more than one air supply. Flexible tubing 44 ties into air header 28 through an appropriate fitting 45 and connects at its other end to elbow 43 which in turn connects to air inlet 37 through an appropriate length of pipe and fitting 47. Gaseous and/or liquid fuel is fed into fuel tube 32 by means of a fuel pipe 41 which connects to fuel tube 32 through the appropriate coupling 36.

The unitized bung of burners 24 for the furnace illustrated in FIGS. 1 and 2 comprises the six burners tied into the common air header with each burner firing in parallel relationship to the movement of the tubing being treated and are located in the confined areas between the walking beams in the space between the furnace hearth and the pass line. It will also be recognized that it may be desirable to fire at a particular divergent angle with the pass line to compensate for the natural buoyancy of the flame under modulated fuel inputs. In the furnace of FIGS. 1 and 2, the burners 24 fire toward the charging end of the furnace and the flue stack 18 in counterflow relationship to the oil country tubing conveyed on the walking beam conveyor 14. The top fired burners are conventional and are not shown in FIGS. 1 and 2.

Figure 5:
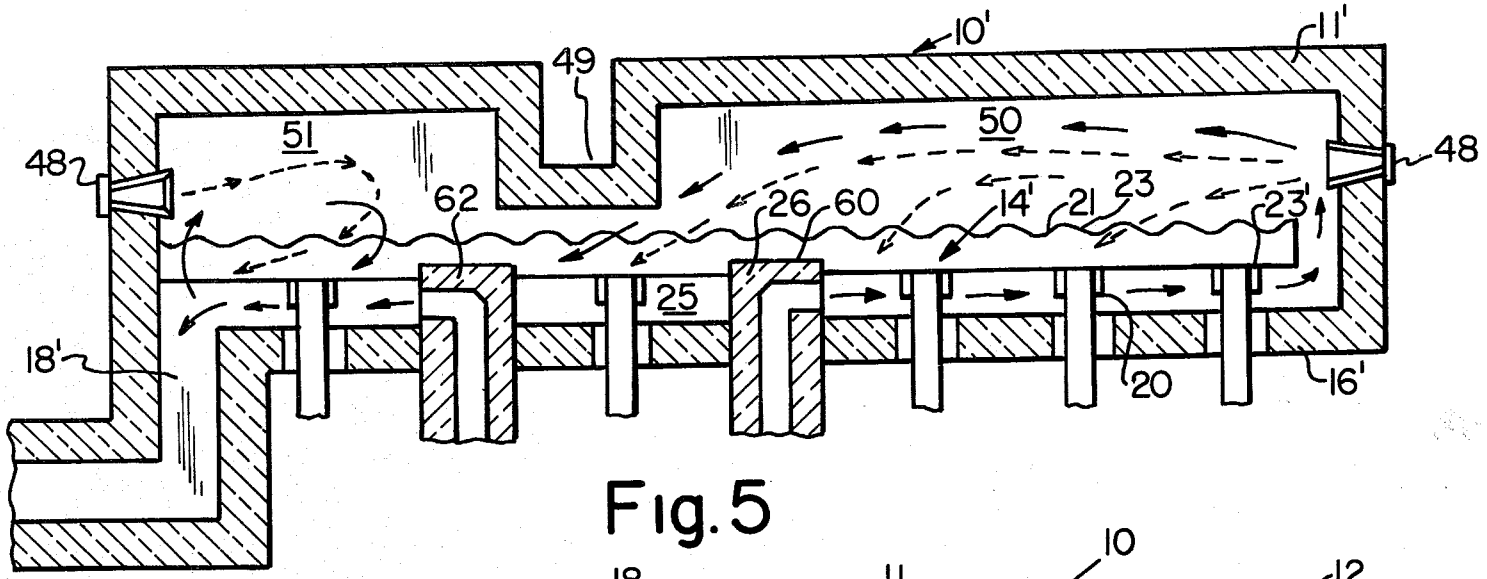
FIG. 5 is a schematic in longitudinal section through the refractory shell of another type of furnace retrofitted with our invention.

The general arrangement of the furnace to be retrofit dictates the positioning of the unitized bung of burners. A furnace 10' illustrated in FIG. 5 is outlined for illustration purposes only by the refractory lining 11' and the hearth 16'. The particular furnace 10' includes a flue 18' located at the charging end of the furnace and exiting through the hearth 16' rather than through the roof as in the earlier embodiment. In addition, a water cooled knuckle forms a baffle 49 extending downwardly from the roof and dividing the furnace 10' into a heating zone 51 and a soak zone 50. Top firing is accomplished by rows of burners 48 positioned in the respective end walls. The walking beam conveyor 14' is identical to the earlier embodiment comprising rows of walking beams 20 with each walking beam terminating in a saddle 23' to accommodate the oil country tubing being conveyed. In order to obtain appropriate flow of the flame and products of combustion for uniform heating in the particular arrangement of FIG. 5 two unitized bungs of hearth burners 60 and 62 respectively are employed. Each row of burners represents a unitized bung as in the earlier embodiment and is comprised of a number of burners positioned transversely of the hearth 16' and extending through the hearth and floor into the space 25 between the pass line 21 and the furnace hearth. One such unitized bung or row 60 is positioned slightly downstream of and subjacent the baffle 49 and is directed to fire downstream and cocurrent with the movement of the tubing. The second unitized bung or row 62 is positioned slightly upstream of and subjacent the baffle 49 and is directed to fire countercurrent to the incoming product. The general flow of products of combustion and gases from the unitized bungs of burners 60 and 62 are shown in solid arrows whereas the products of combustion and gases from the top fired burners are generally illustrated by dashed arrows.

Figure 6:
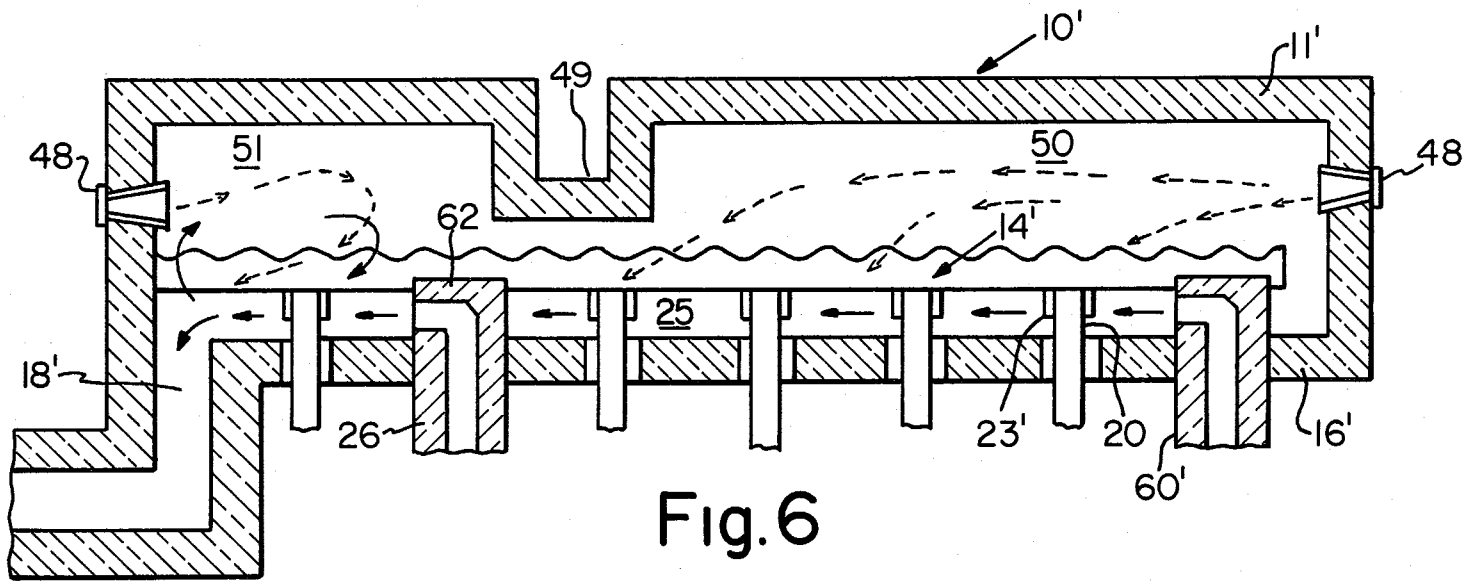
FIG. 6 is a schematic showing still another placement of burners in accordance with our invention.

If the hardware in space 25 permits, the furnace of FIG. 5 can be retrofit to fire entirely countercurrent to the incoming product. Such a furnace 10′ is illustrated in FIG. 6. The furnace 10′ of FIG. 6 differs from the furnace of FIG. 5 only in that bung of burners 60′ is positioned at the discharge end of the furnace and therefore fires in the same direction as the bung of burners 62.

It can therefore be seen that oil country tube walking beam furnaces can be retrofit to embody underfiring by inserting at least one unitized bung of burners through the furnace floor and hearth and into the limited space formed between the pass line and the hearth and firing the burners in parallel relationship to the movement of the tubing.

We claim:

1. A method of retrofitting a top fired walking beam furnace having a furnace chamber including a limited space between the walking beam pass line and the furnace hearth and containing rows of movable and stationary beams to include underfiring comprising:

A. inserting at least one unitized bung of spaced burners into the space between the pass line and hearth and between the beams and transversely of and through the furnace floor, each burner including a right angle turn in said space; and B. introducing fuel and combustion air into the burners and firing the burners into the furnace chamber substantially parallel with the pass line.

2. The method of claim 1 wherein said walking beam furnace is an oil country tube reheat furnace for treating lengths of pipe carried by saddles on the walking beam in said furnace chamber.

3. The method of claim 2, including providing a common air header transversely of and beneath the hearth for providing the combustion air to the burners.

4. The method of claim 2, including firing the burners in countercurrent relationship to the movement of the pipe.

5. The method of claim 2, including inserting more than one bung in spaced relationship, with certain of said bungs of burners firing in countercurrent relationship to product being conveyed by the walking beam and other of said bungs of burners firing in cocurrent relationship to said pipe.

6. In a top fired walking beam oil country tube reheat furnace having a furnace chamber defined by a roof assembly, a floor, a hearth protecting the floor, side walls and end walls and a walking beam conveyor formed of rows of walking beams and fixed beams, said fixed beams defining a pass line at their upper ends and all said beams extending downwardly through said hearth and floor, there being a limited space between the walking beam pass line and the hearth, the improvement comprising:

A. a plurality of burners positioned in spaced relationship transversely of the furnace hearth, each of said burners contained within a refractory housing positioned in the limited space and including a centrally disposed fuel tube having a right angle bend so as to exit at a first end in substantially parallel relationship to the movement of the oil country tubing and just below the pass line and having a second end beneath the furnace floor, a burner body surrounding the fuel tube and forming an annular air chamber thereabout and an apertured baffle located at one end of said air chamber so as to direct air in mixing relationship with the fuel, an air header extending beneath the furnace floor and extending co-directional with said spaced burners, connecting means joining the header and each burner in fluid communication and a fuel line positioned beneath the furnace floor and connected to each of the fuel tube second ends.

7. The improvement of claim 6, said burners positioned in a row and directed to fire countercurrent to a direction of tube travel through the furnace.

8. The improvement of claim 6, including at least two spaced rows of said burners, the burners of each row directed to fire countercurrent to a direction of tube travel through the furnace.

9. In an oil country tube reheat furnace having a series of walking beams positioned in a furnace chamber and extending downward through a furnace hearth protecting a furnace floor, said beams being in rows with each row containing a plurality of spaced beams terminating in tube saddles, a downward extending flue at a discharge end, a charging end, a baffle extending downwardly into the furnace chamber intermediate the ends to divide the furnace chamber into a charging zone and a working zone, burners positioned at both ends above the walking beam pass line and a limited space between the walking beam pass line and the hearth, the improvement comprising a first row of burners positioned in spaced relationship transversely of the furnace hearth in the area upstream of and subjacent the baffle between the spaced walking beams and in the space, each burner including a right angle bend so as to fire substantially parallel with the pass line toward the charging end and a second row of burners positioned in spaced relationship transversely of the furnace hearth in the area downstream of and subjacent the baffle, between the spaced walking beams and in the space, each burner including a right angle bend so as to fire parallel with the pass line toward the discharge end, each of said rows of burners connected to an air header extending parallel with the row and beneath the hearth.

* * * * *